US008096771B2

(12) United States Patent
Liang

(10) Patent No.: US 8,096,771 B2
(45) Date of Patent: Jan. 17, 2012

(54) TRAILING EDGE COOLING SLOT CONFIGURATION FOR A TURBINE AIRFOIL

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 504 days.

(21) Appl. No.: 12/407,876

(22) Filed: Mar. 20, 2009

(65) Prior Publication Data

US 2010/0074763 A1 Mar. 25, 2010

Related U.S. Application Data

(60) Provisional application No. 61/100,121, filed on Sep. 25, 2008.

(51) Int. Cl.

| | |
|---|---|
| ***F01D 5/18*** | (2006.01) |
| ***F01D 5/08*** | (2006.01) |
| ***F01D 5/20*** | (2006.01) |
| ***F01D 5/14*** | (2006.01) |
| ***F03D 11/00*** | (2006.01) |
| ***F04D 29/38*** | (2006.01) |

(52) U.S. Cl. ..... 416/97 R; 415/115

(58) Field of Classification Search ..... 416/97 R; 415/115

See application file for complete search history.

(56) References Cited

U.S. PATENT DOCUMENTS

| | | | | |
|---|---|---|---|---|
| 5,368,441 | A | 11/1994 | Sylvestro et al. | |
| 5,720,431 | A | 2/1998 | Sellers et al. | |
| 5,931,638 | A | 8/1999 | Krause et al. | |
| 6,607,356 | B2 | 8/2003 | Manning et al. | |
| 6,616,406 | B2 | 9/2003 | Liang | |
| 6,902,372 | B2 | 6/2005 | Liang | |
| 6,932,573 | B2 | 8/2005 | Liang | |
| 6,981,846 | B2 | 1/2006 | Liang | |
| 7,165,940 | B2 * | 1/2007 | McGrath et al. | 416/1 |
| 2006/0056967 | A1 | 3/2006 | Liang | |
| 2006/0222494 | A1 | 10/2006 | Liang | |

* cited by examiner

*Primary Examiner* — Michael Lebentritt
*Assistant Examiner* — Valerie N Brown

(57) ABSTRACT

A gas turbine engine hollow turbine airfoil having pressure and suction sidewalls extending chordwise between leading and the trailing edges. The trailing edge includes a pressure sidewall lip and a suction sidewall lip, and a breakout distance between the pressure sidewall lip and the suction sidewall lip. A cooling fluid channel extends spanwise through the airfoil for supplying a cooling fluid to the airfoil. Flow channels are provided extending chordwise between the cooling fluid channel and the suction sidewall lip and include a metering section, an internal diffusion section and a breakout slot. The interior diffusion section includes a spanwise dimension and a widthwise dimension perpendicular to the spanwise dimension, wherein the spanwise dimension continuously increases extending in the chordwise direction, and the widthwise dimension continuously decreases extending in the chordwise direction.

19 Claims, 4 Drawing Sheets

TRAILING EDGE COOLING SLOT CONFIGURATION FOR A TURBINE AIRFOIL

CROSS-REFERENCE TO RELATED APPLICATION

This application claims the benefit of U.S. Provisional Application Ser. No. 61/100,121, entitled METHOD OF FORMING A AIRFOIL TRAILING EDGE COOLING SLOT, filed Sep. 25, 2008, the entire disclosure of which is incorporated by reference herein.

FIELD OF THE INVENTION

This invention is directed generally to turbine airfoils and, more particularly, to turbine airfoils having cooling fluid passages for conducting a cooling fluid to cool a trailing edge of the airfoil.

BACKGROUND OF THE INVENTION

A conventional gas turbine engine includes a compressor, a combustor and a turbine. The compressor compresses ambient air which is supplied to the combustor where the compressed air is combined with a fuel and ignites the mixture, creating combustion products defining a working gas. The working gas is supplied to the turbine where the gas passes through a plurality of paired rows of stationary vanes and rotating blades. The rotating blades are coupled to a rotor and disc assembly. As the working gas expands through the turbine, the working gas causes the blades, and therefore the rotor and disc assembly, to rotate.

Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades comprise a root, a platform and an airfoil that extends outwardly from the platform. The airfoil ordinarily comprises a tip, leading edge and a trailing edge. Most blades typically contain internal cooling channels forming a cooling system. The cooling channels in the blades may receive air from the compressor of the turbine engine and pass the air through the blade. The cooling channels often include multiple flow paths that are designed to maintain the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

Operation of a turbine engine results in high stresses being generated in numerous areas of a turbine blade. One particular area of high stress is found in the airfoil trailing edge, which is a portion of the airfoil forming a relatively thin edge that is generally orthogonal to the flow of gases past the blade and is on the downstream side of the airfoil. Because the trailing edge is relatively thin and an area prone to development of high stresses during operation, the trailing edge is highly susceptible to formation of cracks which may lead to failure of the airfoil.

A conventional cooling system in the airfoil of a turbine blade assembly may include cooling fluid passages to provide convection cooling in the airfoil trailing edge, and discharge a substantial portion of the cooling air through the trailing edge of the airfoil. For example, a typical trailing edge cooling configuration may comprise generally constant diameter cooling passages provided with pin fins extending transversely across the passages to increase the convective cooling in the trailing edge. As a result of this configuration for cooling, a thicker trailing edge is typically required in order to accommodate the passages. In some turbine stage blading designs, a larger trailing edge thickness may induce high blockage and thus reduce the stage performance.

Hence, the size and space limitations make the trailing edge of gas turbine airfoils one of the most difficult areas to cool. In another known configuration, the trailing edge comprises an overhang where the suction sidewall extends further downstream than the pressure sidewall. In such a configuration, the pressure side includes slots for cooling fluid to exit from cooling passages and provide pressure side bleed for the airfoil trailing edge cooling. For example, this type of configuration commonly includes an entrance length having a constant cross sectional area, followed by an expansion in the transverse direction extending between the pressure and suction sidewalls and a constant dimension in the spanwise direction. Subsequently, at a cooling slot breakout defined at the trailing edge overhang, the channel may have an expanded section in the spanwise direction. This type of cooling concept is effective to reduce the airfoil trailing edge thickness, but results in shear mixing between the cooling fluid and the mainstream flow as the cooling fluid exits from the airfoil pressure side. The shear mixing of the cooling fluid with the mainstream flow reduces the cooling effectiveness in the area of the trailing edge overhang and thus may result in an overtemperature condition on the suction side of the airfoil. Frequently, the deterioration of trailing edge overhang area due to overtemperature conditions becomes a limiting condition for the service life of the entire airfoil.

SUMMARY OF THE INVENTION

In accordance with one aspect of the invention, a gas turbine engine hollow turbine airfoil is provided comprising an outer wall surrounding a hollow interior. The outer wall extends radially outwardly in a spanwise direction from an airfoil platform to an airfoil tip. The outer wall includes chordwise spaced apart leading and trailing edges, and widthwise spaced apart pressure and suction sidewalls extending chordwise between the leading edge and the trailing edge. The trailing edge comprises a cutback trailing edge including a pressure sidewall lip and a suction sidewall lip, and defining a breakout distance between the pressure sidewall lip and the suction sidewall lip. The airfoil hollow interior comprises a cooling fluid channel extending in the spanwise direction through the airfoil adjacent to the trailing edge. A plurality of exit ports are defined adjacent to the pressure sidewall lip, between the pressure sidewall and the suction sidewall. A plurality of flow dividers define exit passages communicating between the cooling fluid channel and the exit ports. The flow dividers extend through the breakout distance to the suction sidewall lip to define breakout slots comprising continuations of the exit passages. The exit passages comprise a metering section and an interior diffusion section, wherein the metering section extends from the cooling fluid channel to the interior diffusion section and defines a flow area. The interior diffusion section comprises a spanwise dimension and a widthwise dimension perpendicular to the spanwise dimension, wherein the spanwise dimension continuously increases in a chordwise direction from the metering section to the exit ports, and the widthwise dimension continuously decreases in the chordwise direction from the metering section to the exit ports.

In accordance with another aspect of the invention, a gas turbine engine hollow turbine airfoil is provided comprising an outer wall surrounding a hollow interior. The outer wall extends radially outwardly in a spanwise direction from an airfoil platform to an airfoil tip. The outer wall includes chordwise spaced apart leading and trailing edges, and widthwise spaced apart pressure and suction sidewalls extending chordwise between the leading edge and the trailing edge. The trailing edge comprises a cutback trailing edge including a pressure sidewall lip and a suction sidewall lip, and defines a breakout distance between the pressure sidewall lip and the suction sidewall lip. The airfoil hollow interior comprises a cooling fluid channel extending in the spanwise direction through the airfoil adjacent to the trailing edge. A plurality of exit ports are defined adjacent to the pressure sidewall lip, between the pressure sidewall and the suction sidewall. A plurality of flow dividers form flow channels extending from the cooling fluid channel to the suction sidewall lip, each flow channel comprises an exit passage communicating between the cooling fluid channel and a respective exit port, and breakout slots defined by a section of the flow dividers extending through the breakout distance. The exit passages comprise a metering section and an interior diffusion section. The metering section comprises a substantially constant flow area of circular cross section extending from the cooling fluid channel to the interior diffusion section. The interior diffusion section comprises a spanwise dimension and a widthwise dimension perpendicular to the spanwise dimension, wherein the spanwise dimension continuously increases in a chordwise direction from the metering section to the exit ports, and the widthwise dimension continuously decreases in the chordwise direction from the metering section to the exit ports.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
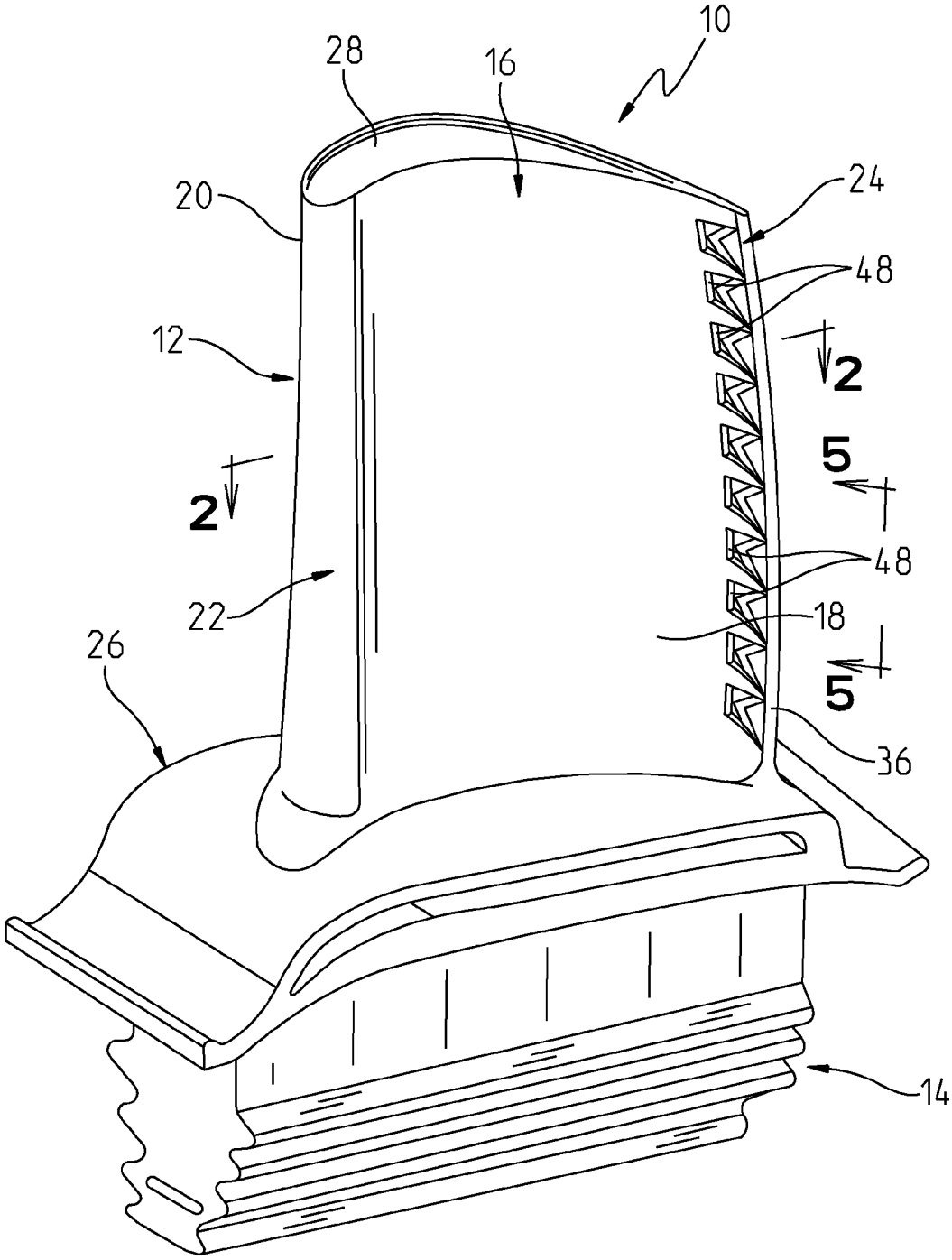
FIG. 1 is a perspective view of a turbine blade including an airfoil incorporating the present invention.
Figure 2:
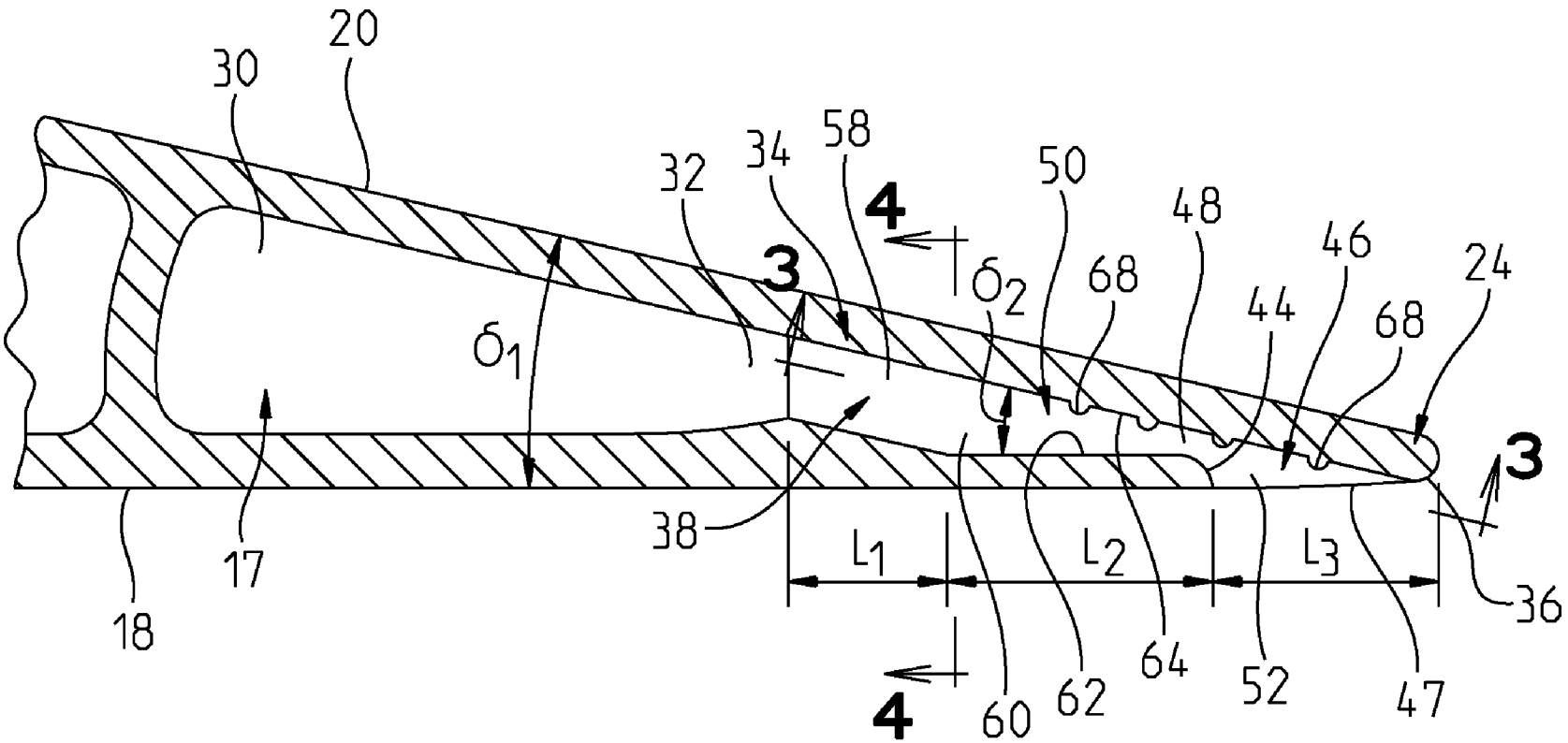
FIG. 2 is a FIG. 2 is a cross-sectional view of the airfoil of FIG. 1 taken along line 2-2 and showing a trailing edge flow channel in accordance with the present invention.

Referring to FIG. 1, an exemplary turbine blade 10 for a gas turbine engine is illustrated in accordance with the present invention. It should be understood that although the present invention is described with specific reference to the illustrated blade 10, the invention may be implemented in similar turbine structure such as a turbine vane airfoil. The blade 10 includes an airfoil 12 and a root 14 which is used to conventionally secure the blade 10 to a rotor disk of the engine for supporting the blade 10 in the working medium flow path of the turbine where working medium gases exert motive forces on the surfaces thereof. The airfoil 12 has an outer wall 16 surrounding a hollow interior 17 (FIG. 2). The airfoil outer wall 16 comprises a generally concave pressure sidewall 18 and a generally convex suction sidewall 20 which are spaced apart in a widthwise direction to define the hollow interior 17 therebetween. The pressure and suction sidewalls 18, 20 extend between and are joined together at an upstream leading edge 22 and a downstream trailing edge 24. The leading and trailing edges 22, 24 are spaced axially or chordally from each other. The airfoil 12 extends radially along a longitudinal or radial direction of the blade 10, defined by a span of the airfoil 12, from a radially inner airfoil platform 26 to a radially outer blade tip surface 28.

Referring to FIG. 2, at least one cooling fluid channel 30 is defined in the hollow interior 17. The cooling fluid channel 30 extends spanwise through the turbine blade 10 and is in fluid communication with a supply of cooling fluid. The cooling fluid channel 30 passes through the airfoil 12 between the pressure sidewall 18 and the suction sidewall 20 to transfer heat from the surfaces of the airfoil sidewalls 18, 20 to the cooling fluid and to maintain the temperature of the blade 10 below a maximum allowable temperature. The cooling fluid channel 30 may comprise a serpentine flow channel or may comprise a single up pass radial channel for directing a cooling fluid, such as cooling air, through the airfoil 12 and out various orifices or openings in the outer wall 16 of the airfoil 12.

Figure 3:
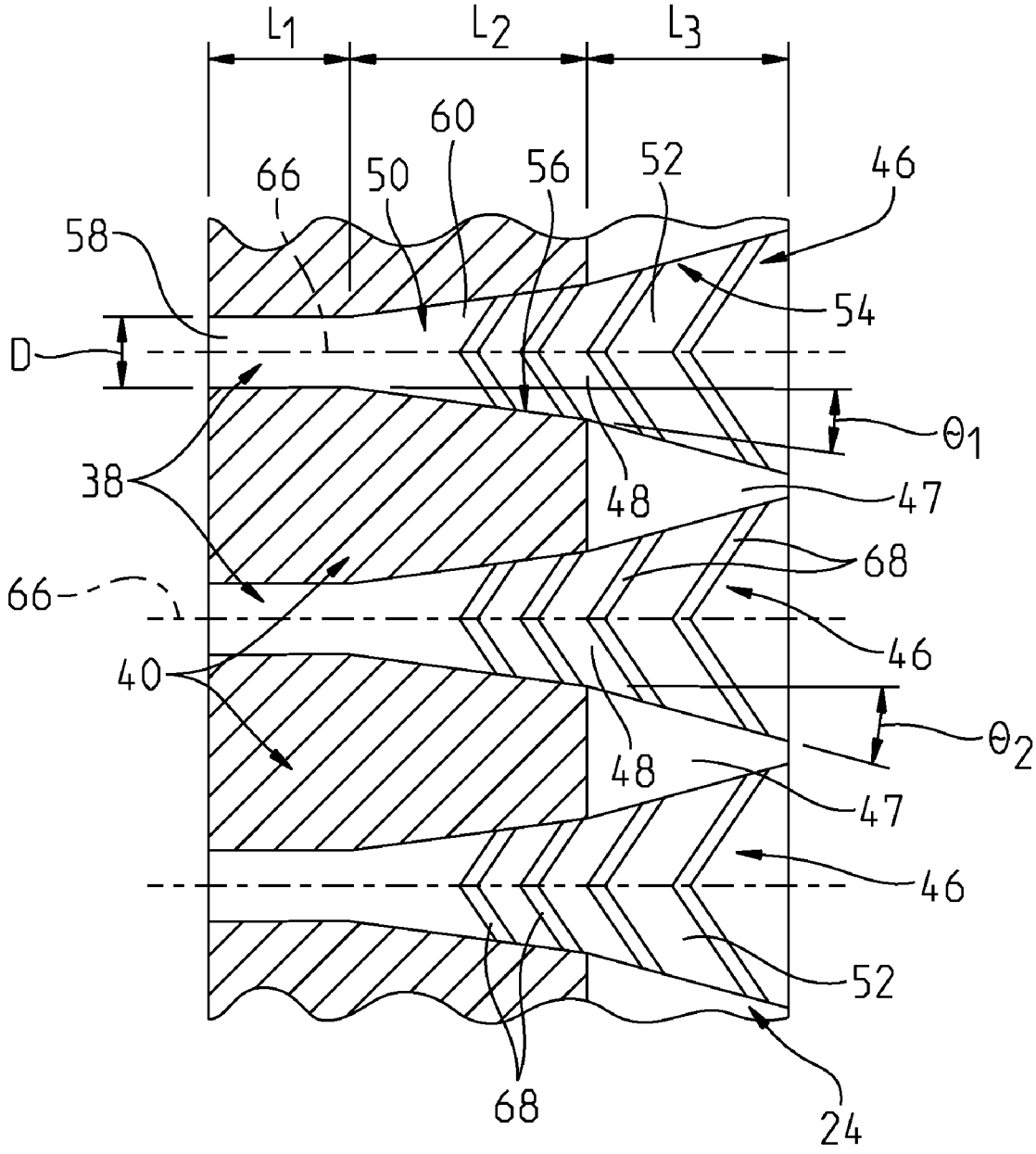
FIG. 3 is a cross-sectional view of the airfoil of FIG. 2 taken along line 3-3 and showing a plurality of trailing edge flow channels in elevation view.

The cooling fluid channel 30 includes a trailing edge end 32 located adjacent to a trailing edge cooling section 34. The trailing edge cooling section 34 extends from a suction sidewall lip 36 to the trailing edge end 32 of the cooling fluid channel 30. A plurality of flow channels 38 extend chordwise through the trailing edge cooling section 34 and are defined between a plurality of spanwise spaced flow dividers 40, as seen in FIG. 3. The flow dividers 40 extend chordwise from the cooling fluid channel 30 to a location at or near the suction sidewall lip 36.

The pressure sidewall 18 terminates at a pressure sidewall lip 44 located chordally spaced upstream from the suction sidewall lip 36. A breakout area 46 of the trailing edge 24 extends along a breakout distance, corresponding to length $L_3$, between the pressure sidewall lip 44 and the suction sidewall lip 36. An exterior portion 47 of each flow divider 40 extends through the breakout distance.

A plurality of exit ports 48 are defined adjacent to the pressure sidewall lip 44, between the pressure sidewall 18 and the suction sidewall 20. Each exit port 48 comprises an opening connecting a portion of the flow channel 38 defining an exit passage 50, interior to the airfoil 10, to a portion of the flow channel 38 defining a breakout slot 52, exterior to the airfoil 10 along an exposed or exterior surface of the suction sidewall 20 on the pressure side of the airfoil 10. The flow dividers 40 each include an upper wall 54 and a lower wall 56, wherein an interior portion of the upper and lower walls 54, 56 form upper and lower boundaries of the exit passage 50 and are contiguous with an exterior portion of the upper and lower walls 54, 56 forming the breakout slot 52.

As seen in FIGS. 2 and 3, the flow channel 38 comprises first, second and third sections, identified by lengths $L_1$, $L_2$ and $L_3$, respectively. The exit passage 50 of the flow channel 38 is formed by the first section comprising a metering section 58 and by the second section comprising an interior diffusion section 60. The third section of the flow channel 38 is defined by the breakout slot 52.

Figure 4:
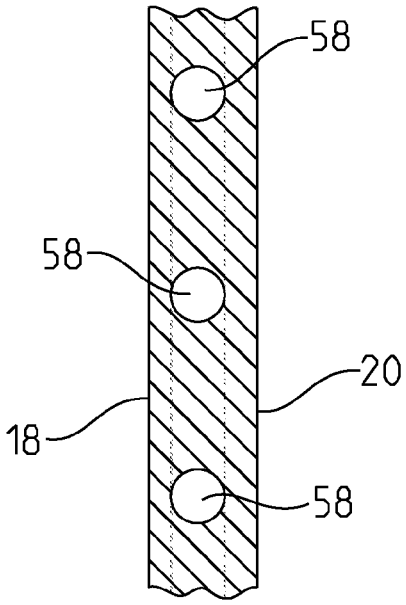
FIG. 4 is a cross-sectional view of the airfoil of FIG. 2 taken along line 4-4 and showing a cross-sectional profile of a plurality of the trailing edge flow channels at the exit to the metering section of the flow channels.

The metering section 58 is preferably formed with a circular cross section (see FIG. 4) having a substantially constant flow area, i.e., a constant diameter D (FIG. 3), extending from the cooling fluid channel 30 to the interior diffusion section 60, and having a length $L_1$ that is two to three times the diameter D. The metering section 58 meters a controlled amount of cooling fluid from the cooling fluid channel to the flow channel 38.

Figure 5:
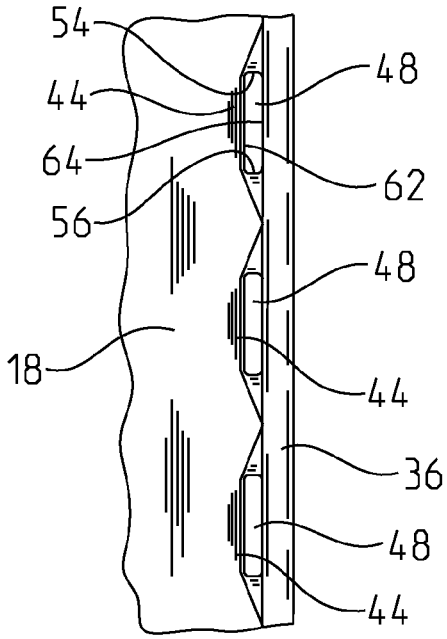
FIG. 5 is an elevational end view of the airfoil of FIG. 1 taken along line 5-5.

The interior diffusion section 60 comprises a spanwise dimension, extending radially between the upper and lower walls 54, 56 (FIG. 3), and a widthwise dimension, extending perpendicular to the spanwise dimension and measured between an inner pressure side wall 62 and an inner suction side wall 64, as seen in FIG. 2. The spanwise dimension continuously increases in the chordwise direction from the metering section 58 to the exit port 48, and the widthwise dimension continuously decreases in the chordwise direction from the metering section 58 to the exit port 48. Hence, the interior diffusion section 60 defines a flow area that transitions from a circular cross section at the exit to the metering section 58 (FIG. 4) to a relatively thin, spanwise elongated slot at the exit port 48 (FIG. 5), i.e., a generally rectangular slot with a major dimension extending in the radial direction.

The increasing spanwise dimension of the interior diffusion section 60 is defined by a first diffusion angle $\theta_1$ (FIG. 3), measured from either of the upper and lower walls 54, 56 to a centerline 66 of the metering section 58, corresponding to a centerline for the flow channel 38. The upper and lower walls 54, 56 of the interior diffusion section 60 preferably diverge from the centerline 66 at the same first diffusion angle $\theta_1$. The decreasing widthwise dimension of the interior diffusion section 60 is defined by an interior angle of convergence $\sigma_2$ (FIG. 2) measured between the inner pressure side wall 62 and the inner suction side wall 64. The first diffusion angle $\theta_1$ is preferably within a range of approximately 7 to 10 degrees, and the interior angle of convergence $\sigma_2$ for the inner pressure and suction side walls 62, 64 is preferably substantially equal to an exterior angle of convergence $\sigma_1$ defined between the exterior surfaces of the pressure sidewall 18 and the suction sidewall 20. The exterior angle of convergence $\sigma_1$ may typically be between approximately 7 and 15 degrees.

The first diffusion angle $\theta_1$ is selected with reference to the interior angle of convergence $\sigma_2$ and with reference to a desired expansion ratio for the interior diffusion section 60. The expansion ratio is defined by a ratio of the flow area of the interior diffusion section 60 at the exit port 48 relative to a flow area of the interior diffusion section 60 at the metering section 58. In a preferred embodiment, the expansion ratio is in a range from greater than 5 up to approximately 10. Increasing the expansion ratio facilitates a decrease in the momentum of the cooling fluid exiting the exit ports 48, reducing the shear mixing of cooling fluid with the hot working gas.

Referring to FIG. 3, the breakout slot 52 comprises a spanwise dimension, extending radially between the exterior portions of the upper and lower walls 54, 56. The spanwise dimension of the breakout slot 52 continuously increases in the chordwise direction from the interior diffusion section 60 to the suction sidewall lip 36. The increasing spanwise dimension of the breakout slot 52 is defined by a second diffusion angle $\theta_2$, measured from the exterior portion of either of the upper and lower walls 54, 56 to the centerline 66. The upper and lower walls 54, 56 of the breakout slot 52 preferably diverge from the centerline 66 at the same second diffusion angle $\theta_2$. The second diffusion angle $\theta_2$ is preferably greater than the first diffusion angle $\theta_1$ by an amount up to approximately 13 degrees, and is preferably within a range of approximately 7 to 20 degrees.

It should be noted that the successively increasing angle of divergence from the first diffusion angle $\theta_1$ to the second diffusion angle $\theta_2$ provides for a greater overall angle of divergence from the metering section 60 to the suction sidewall rib 36 while preventing or limiting separation of the cooling fluid flow from the surfaces of the upper and lower walls 54, 56. The reduced width dimension defined by the converging inner pressure and suction side walls 62, 64 through the interior diffusion section 60 provides an accelerated flow that facilitates convective heat transfer through the interior diffusion section 60. In addition, the suction side wall 64 of the interior diffusion section 60 and the exterior surface of the suction sidewall 20 (on the pressure side) forming the breakout slot 52 may be provided with chevron or V-shaped trip strips 68 (FIG. 3) to break up the boundary layer at these surfaces and further facilitate convective heat transfer along the surfaces of each flow channel 38.

Figure 6:
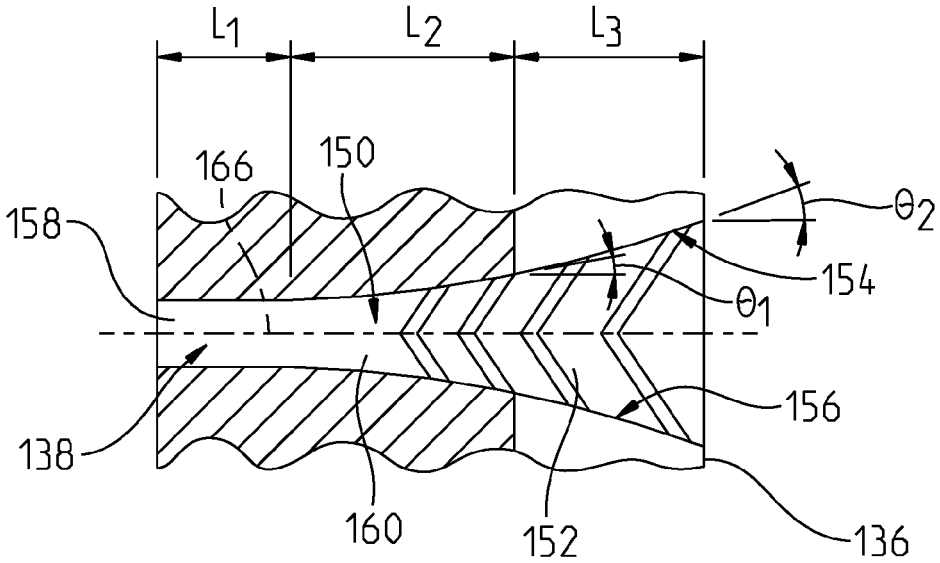
FIG. 6 is a cross-sectional view similar to FIG. 2, showing one flow channel and illustrating an alternative embodiment of the invention.

In an alternative embodiment of the successively expanding flow channel 38, the upper and lower walls 54, 56 of one or both of the interior diffusion section 60 and the breakout slot 52 may be formed with outwardly curved surfaces, as illustrated in FIG. 6 in which elements corresponding to the previously described embodiment are identified with the same reference numerals increased by 100.

As seen in FIG. 6, a flow channel 138 comprises an exit passage 150 defined by a metering section 158, an interior diffusion section 160, and includes a breakout slot 152 extending as a continuation of the exit passage 150 from an exit port 148. The flow channel 138 of the present embodiment is similar to the flow channel 38 described for the previous embodiment in that the metering section 158 is a constant diameter portion of the flow channel 138 and the width of the flow channel 138 in the interior diffusion section 160 converges in the chordwise direction of cooling fluid flow. However, rather than the linear upper and lower walls 54, 56 described for the previous embodiment, the upper and lower walls 154, 156 for both the interior diffusion section 160 and the breakout slot 152 are formed with an increasing outward curvature. The upper and lower walls 154, 156 of the interior diffusion section 160 are curved outwardly, such that a first diffusion angle $\theta_1$ formed between a centerline 166 and a tangent to either the upper wall 154 or lower wall 156 at the exit to the interior diffusion section 160 is within a range of approximately 7 to 10 degrees. The upper and lower walls 154, 156 of the breakout slot 152 continue the outward increasing curvature, such that a second diffusion angle $\theta_2$ formed between the centerline 166 and a tangent to either the upper wall 154 or the lower wall 156 at the suction sidewall lip 136 is between approximately 7 and 20 degrees. As with the previous embodiment, the second diffusion angle $\theta_2$ is preferably greater than the first diffusion angle $\theta_1$.

The configuration of the upper and lower walls 154, 156 may comprise a combination of linear and curved surfaces. For example, one of the interior diffusion section 60 (160) and the breakout slot 52 (152) may be formed with linear upper and lower walls 54, 56 (154, 156) and the other of the interior diffusion section 60 (160) and the breakout slot 52 (152) may be formed with curved upper and lower walls 54, 56 (154, 156). Alternatively, one or both of the interior diffusion section 60 (160) and the breakout slot 52 (152) may be formed with a combination of linear and curved upper and lower walls 54, 56 (154, 156).

It should be noted that, while the preferred embodiments described above may be implemented to provide increased trailing edge heat transfer by providing an increased expansion ratio through the flow channel 38 (138), the invention may be implemented to provide alternative flow characteristics through the flow channel 38 (138). For example, the spanwise divergence may be selected with reference to the widthwise convergence to provide a constant flow area throughout the exit passage 50(150).

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A gas turbine engine hollow turbine airfoil comprising:

an outer wall surrounding a hollow interior;

said outer wall extending radially outwardly in a spanwise direction from an airfoil platform to an airfoil tip, said outer wall including chordwise spaced apart leading and trailing edges, and widthwise spaced apart pressure and suction sidewalls extending chordwise between said leading edge and said trailing edge;

said trailing edge comprising a cutback trailing edge including a pressure sidewall lip and a suction sidewall lip, and defining a breakout distance between said pressure sidewall lip and said suction sidewall lip;

said airfoil hollow interior comprising a cooling fluid channel extending in the spanwise direction through said airfoil adjacent to said trailing edge;

a plurality of exit ports defined adjacent to said pressure sidewall lip, between said pressure sidewall and said suction sidewall;

a plurality of flow dividers defining exit passages communicating between said cooling fluid channel and said exit ports;

said flow dividers extending through said breakout distance to said suction sidewall lip to define breakout slots comprising continuations of said exit passages;

said exit passages comprising a metering section and an interior diffusion section, said metering section extending from said cooling fluid channel to said interior diffusion section and defining a flow area; and said interior diffusion section comprising a spanwise dimension and a widthwise dimension perpendicular to said spanwise dimension, wherein said spanwise dimension continuously increases in a chordwise direction from said metering section to said exit ports, and said widthwise dimension continuously decreases in said chordwise direction from said metering section to said exit ports.

2. The turbine airfoil as set out in claim 1, wherein said metering section for each said exit passage is defined by a substantially constant flow area from said cooling fluid channel to said interior diffusion section.

3. The turbine airfoil as set out in claim 2, wherein said flow area of said metering section for each said exit passage comprises a circular cross section defining a diameter and said metering section has a length, extending from said cooling fluid channel to said interior diffusion section that is two to three times the diameter of said metering section.

4. The turbine airfoil as set out in claim 3, wherein said interior diffusion section for each said exit passage defines a flow area comprising a circular cross section at said metering section and transitioning to a spanwise elongated slot at said exit port.

5. The turbine airfoil as set out in claim 1, wherein said pressure sidewall and said suction sidewall comprise exterior surfaces of said airfoil converging toward each other at an angle of convergence adjacent to said trailing edge, and wherein said widthwise dimension of said interior diffusion section is defined by opposing side walls angled toward each other, extending in the chordwise direction, at the same angle as said angle of convergence.

6. The turbine airfoil as set out in claim 5, wherein a suction side wall of said opposing side walls and an exterior suction side wall defining said breakout slots each include V-shaped trip strips.

7. The turbine airfoil as set out in claim 1, wherein said spanwise dimension of each said interior diffusion section is defined by an interior section of upper and lower walls formed on said flow dividers, and wherein said interior section of said upper and lower walls each diverge from a centerline of a respective metering section at a first diffusion angle within a range of 7 to 10 degrees.

8. The turbine airfoil as set out in claim 7, wherein each said breakout slot comprises an exterior section of said upper and lower walls formed on said flow dividers and contiguous with said interior section of said upper and lower walls of a respective interior diffusion section, and wherein said exterior upper and lower walls each diverge from said centerline of said respective metering section at a second diffusion angle within a range of 7 to 20 degrees.

9. The turbine airfoil as set out in claim 8, wherein said second diffusion angle is greater than said first diffusion angle.

10. The turbine airfoil as set out in claim 9, wherein said second diffusion angle is greater than said first diffusion angle by an amount up to 13 degrees.

11. The turbine airfoil as set out in claim 8, wherein an expansion ratio is defined by a ratio of a flow area of said interior diffusion section at said exit port relative to a flow area of said interior diffusion section at said metering section, and said expansion ratio is in a range from greater than 5 up to 10.

12. A gas turbine engine hollow turbine airfoil comprising:

an outer wall surrounding a hollow interior;

said outer wall extending radially outwardly in a spanwise direction from an airfoil platform to an airfoil tip, said outer wall including chordwise spaced apart leading and trailing edges, and widthwise spaced apart pressure and suction sidewalls extending chordwise between said leading edge and said trailing edge;

said trailing edge comprising a cutback trailing edge including a pressure sidewall lip and a suction sidewall lip, and defining a breakout distance between said pressure sidewall lip and said suction sidewall lip;

said airfoil hollow interior comprising a cooling fluid channel extending in the spanwise direction through said airfoil adjacent to said trailing edge;

a plurality of exit ports defined adjacent to said pressure sidewall lip, between said pressure sidewall and said suction sidewall;

a plurality of flow dividers forming flow channels extending from said cooling fluid channel to said suction sidewall lip, each said flow channel comprising an exit passage communicating between said cooling fluid channel and a respective exit port, and breakout slots defined by a section of said flow dividers extending through said breakout distance;

said exit passages comprising a metering section and an interior diffusion section, said metering section comprising a substantially constant flow area of circular cross section extending from said cooling fluid channel to said interior diffusion section; and said interior diffusion section comprising a spanwise dimension and a widthwise dimension perpendicular to said spanwise dimension, wherein said spanwise dimension continuously increases in a chordwise direction from said metering section to said exit ports, and said widthwise dimension continuously decreases in said chordwise direction from said metering section to said exit ports.

13. The turbine airfoil as set out in claim 12, wherein said metering section has a length, extending from said cooling fluid channel to said interior diffusion section that is two to three times a diameter of said metering section.

14. The turbine airfoil as set out in claim 13, wherein said pressure sidewall and said suction sidewall comprise exterior surfaces of said airfoil converging toward each other at an angle of convergence adjacent to said trailing edge, and wherein said widthwise dimension of said interior diffusion section is defined by opposing side walls angled toward each other, extending in the chordwise direction, at the same angle as said angle of convergence.

15. The turbine airfoil as set out in claim 14, wherein said breakout slots comprise a spanwise dimension that continuously increases from said interior diffusion section to said suction sidewall lip.

16. The turbine airfoil as set out in claim 15, wherein said spanwise dimension of said interior diffusion section and said breakout slot of each said flow channel is defined by upper and lower walls that diverge from a centerline of a respective metering section at an angle of at least 7 degrees.

17. The turbine airfoil as set out in claim 16, wherein said upper and lower walls of said breakout slot diverge at a greater angle than an angle at which said upper and lower walls of said interior diffusion section diverge from said centerline of said metering section.

18. The turbine airfoil as set out in claim 17, wherein said upper and lower walls are curved within at least one of said interior diffusion section and said breakout slot, and an angle of divergence within said at least one of said interior diffusion section and said breakout slot increases in said chordwise direction.

19. The turbine airfoil as set out in claim 12, wherein a flow area within each said interior diffusion section is constant from a location adjacent to said metering section to said exit port.

* * * * *